United States Patent [19]

Ekstrom

[11] Patent Number: 4,890,597

[45] Date of Patent: Jan. 2, 1990

[54] ARROW GUN

[75] Inventor: Glen Ekstrom, Unionville, Canada

[73] Assignee: Swivel Machine Works, Inc., Unionville, Ontario, Canada

[21] Appl. No.: 194,847

[22] Filed: May 17, 1988

[51] Int. Cl.[4] ..... F41B 11/06; F41B 11/08; F41B 11/10; A01K 81/06

[52] U.S. Cl. ..... 124/74; 124/56; 124/71; 124/73; 43/6

[58] Field of Search ..... 124/56, 57, 70, 71, 124/73, 74; 43/6

[56] References Cited

U.S. PATENT DOCUMENTS

| | | | |
|---|---|---|---|
| 2,504,525 | 4/1950 | Holderness | 124/74 X |
| 2,642,056 | 6/1953 | Harris . | |
| 2,703,944 | 3/1955 | Molyneux | 124/73 X |
| 2,723,656 | 11/1955 | Andina | 124/57 |
| 2,833,266 | 5/1958 | Mares | 43/6 X |
| 2,839,862 | 6/1958 | Hanshaw | 124/73 X |
| 2,900,972 | 8/1959 | Marsh et al. . | |
| 2,957,468 | 10/1960 | Enfield | 124/71 X |
| 2,964,031 | 12/1960 | Dotson | 124/71 X |
| 3,102,525 | 9/1963 | Englis | 124/74 X |
| 3,142,293 | 7/1964 | Harter | 124/71 X |
| 3,735,747 | 5/1973 | Barjavel . | |
| 3,780,720 | 12/1973 | Alderson | 124/74 |
| 4,660,315 | 4/1987 | Ferro | 43/6 |

*Primary Examiner*—Randolph A. Reese
*Assistant Examiner*—John A. Ricci
*Attorney, Agent, or Firm*—Scully, Scott, Murphy & Presser

[57] ABSTRACT

An arrow gun and method for propelling arrows or harpoons in which the gun includes a compressed gas source such as compressed air or $CO_2$, a handle and trigger arrangement, and a high pressure air passageway system for linking the barrel to the gas source to propel or discharge the arrow. The arrow or harpoon is hollow and is slid over the barrel of the gun so that the barrel guides the arrow upon firing. The air passageway system is responsive to the actuation of the trigger such that the gun when loaded is not subject to pressure build-up and thus avoids accidental discharge hazards. Arrows with or without fletching may be used and are held in place when loaded without latching or locking. Arrows without fletching are held in the loaded position by a tapered seating gap arranged at the point where the barrel connects to the gun, while arrows with fletching are engaged in a shroud cover which surrounds the barrel at the gun handle end.

21 Claims, 4 Drawing Sheets

ARROW GUN

BACKGROUND OF THE INVENTION

1. Field of the Invention

The present invention relates to arrow and harpoon guns, and more particularly, to guns which propel a hollow arrow or harpoon using a compressed gas source such as compressed air or $CO_2$ to propel the arrow.

Harpoon or arrow guns using an energy source such as compressed gas are well known in the art. These devices generally latch an arrow or harpoon into the barrel of the gun and energize the gun under high pressure prior to firing the arrow. The known compressed gas sources vary, and may include portable air bottles, $CO_2$ cartridges, scuba tanks, and the like. These guns are primarily for underwater use such as for spearing fish, but may be for use in other activities such as hunting.

2. Discussion of the Prior Art

In the prior art, various types of guns are disclosed, along with different types of arrows or harpoons, and several types of compressed air sources. These various devices, however, are subject to several disadvantages which, in many cases, inconvenience the user, and in some cases, require careful and specialized handling of the gun, since the gun when loaded is in a highly volatile condition where the possibility of accidental discharge is a hazard.

Mares, U.S. Pat. No. 2,833,266, discloses a spearfishing gun provided with a hollow-type spear which slides over an inner barrel of the gun and under a short outer barrel located near the handle. A compressible stopper is provided inside the spear tip to seal the open end of the inner barrel so that as the spear is latched, or locked, into the gun, the gun may be energized without leaking. Latching occurs due to a notched area on the shaft of the spear engaging a clip in the gun handle. The gun is energized by an attached compressed air container. This type of gun presents a typical but serious hazard to the user, since the gun is under high pressure while it is loaded and accidental discharge of the spear may occur. Once the spear is in place, the gun is always under an energized condition, so that mishandling may be hazardous.

Englis, U.S. Pat. No. 3,102,525, discloses an underwater dart or spear gun where the dart is placed over a short barrel of the gun similar to Mares. A $CO_2$-cartridge is located in the tip of the hollow dart, so that pulling the trigger forces a pointed-tip rod to extend into the dart to puncture the $CO_2$-cartridge, thus propelling the dart. This gun is also hazardous and must be carefully handled, since there is necessarily a very short distance from the pointed tip rod to the $CO_2$-cartridge, resulting in the possibility of accidental discharge. Furthermore, upon puncture of the cartridge, pressure is allowed to build in the gun, and the arrow is released only after complete depression of the trigger. This device suffers the further disadvantage that the darts are re-usable only after disassembly and replacement of the $CO_2$-cartridge.

Enfield, U.S. Pat. No. 2,957,468, is similar to Englis and also discloses a hollow arrow which slides over the barrel of the gun, and which is provided with a $CO_2$-cartridge in the tip of the arrow. The arrow is latched, or locked, onto the barrel and a pointed-tip rod moves forward upon pulling the trigger to puncture the $CO_2$-cartridge to propel the arrow. This device, of course, suffers the same disadvantages of the Englis device.

Andina, U.S. Pat. No. 2,723,656, discloses a gun in which a hollow dart fits inside the barrel of the gun and latches in place. Pressure is built up in the barrel to pressurize the dart prior to firing. The pressure build-up, of course, imparts the same disadvantage to this gun as described above, in that the hazard of accidental discharge always exists.

The novel arrow gun pursuant to the present invention obviates the disadvantages of the prior art and provides a highly accurate and powerful gun which is also safe to handle whether loaded or unloaded. It relieves the danger associated with prior art guns which energize the gun after the arrow is loaded and prior to firing. Accordingly, accidental discharge and the associated risk of injury is minimized or eliminated in the present invention. The present invention also provides a novel means for holding the arrow in place on the barrel after loading so that latching or locking the arrow in place is eliminated. Accordingly, jamming of the firing mechanism is avoided, and the arrow may be disengaged if necessary without firing the gun simply by sliding the arrow off the barrel.

Several guns disclosed in the prior art attempt to avoid the problem of latching or locking the arrow into the barrel. However, these guns, such as the gun disclosed in Hanshaw, U.S. Pat. No. 2,839,862, use a solid arrow or harpoon which fits into the barrel and is provided with a stopper-like end which seals the barrel after the arrow is inserted so that pressure builds up behind the stopper of the arrow to eventually force the arrow out of the barrel upon firing. Hanshaw also provides a stopper-like seal at the open end of the barrel, so that a hazardous pressure build-up may exist in the event the seal is too tight or the arrow jams. However, if the seal is not tight enough upon firing, the pressure will not be great enough to effectively propel the arrow.

A further disadvantage associated with the guns such as Hanshaw is that, due to the tolerances necessary to effect the proper build-up of pressure, arrows or harpoons with fletching may not be used. The fletching, of course, provides for accuracy in the flight of the arrow after firing. While the use of arrows or darts with fletching is possible in some guns in which the arrow is placed over the barrel, such as disclosed in Englis above, the fletching must be manually aligned upon loading to straddle the sides of the gun to allow for latching the arrow onto the barrel. In addition, if an outer barrel is provided such as that disclosed in Mares, the fletching again becomes prohibitive to the use of the gun.

SUMMARY OF THE INVENTION

The present invention eliminates or substantially ameliorates the disadvantages encountered in the prior art through the of an arrow gun which avoids pressure build-up in the barrel until actual intended discharge of the gun. The user of the gun is protected from injury due to the accidental discharge of the gun, since pressure is applied to the barrel only upon actuation of the trigger mechanism to propel the arrow. Furthermore, the construction of the gun provides for high accuracy during use, since the arrows used slide over the barrel and use the barrel as a guide upon firing. Accuracy is also enhanced by the provision for fletching on the arrow, which of course aids in the accuracy of the flight path of the arrow.

A lightweight, easy to assemble and disassemble gun is provided with a source of compressed gas, which may be in the form of an attached compressed air or $CO_2$ container. The source of compressed gas may, of course, be any system for supplying compressed gas, such as a compressed air or $CO_2$ cartridge, a tank mounted on a boat, a scuba tank for underwater use, or the like. The source of compressed gas is attached directly to the gun, and is responsive to actuation of the trigger. Prior to firing, there is no pressure build-up in the barrel of the gun, and after discharge of the arrow, there is again no pressure in the barrel so safe reloading is possible.

The gun of the present invention consists of a handle and trigger assembly with an integral air passageway system for connection of the compressed gas source to the handle of the gun. The air passageway system leads from the compressed gas source to the barrel to feed the compressed gas to the barrel for discharging the arrow upon actuation of the trigger. The barrel may be detachable and is connected to the handle by a collar, which properly seals the barrel to prevent pressure loss during firing of the arrow. The collar is provided with a novel means for seating the arrow, which is loaded onto the barrel by sliding the arrow over the barrel. A tapered gap is provided on the inner diameter of the collar which creates a seating gap which acts to releasably secure the arrow. The arrow may be "unloaded" if necessary by simply sliding it off the barrel, since there is no latching or locking of the arrow as in the prior art.

The arrow, as stated, slides over the barrel and has an inner diameter which is slightly larger than the outer diameter of the barrel. The arrow, having a length slightly longer than the barrel, is "centered" due to the close tolerances between the arrow and barrel and is, therefore, discharged upon firing with extreme accuracy, since the barrel guides the arrow as it is fired. The arrow is held in place by the seating gap created by the tapered diameter of the inner surface of the collar. The arrow may or may not be provided with fletching to further increase the accuracy of a shot. In a further embodiment, a shroud cover may be provided on the collar which extends a distance along the length of the barrel, such that for that length the shroud coaxially encloses the barrel. The shroud is provided with an inner diameter which is slightly less than the diameter formed by the fletching on the arrow. As the arrow is loaded onto the barrel, it is rotated slightly to bend or roll over the fletching, so that upon firing the fletching "uncoils" and causes the arrow to spin at a faster rate to increase accuracy. This allows for a so-called "free floating" barrel, since the barrel is automatically centered by the fletching within the shroud. The fletching within the shroud also holds the arrow in place, so that the seating gap on the collar becomes optional when the shroud and fletching are present.

The entire gun itself may be handheld, in either pistol or rifle form, or it may be stand-mounted for use as a harpoon-type gun on a boat. In that case, a rope or tether system may be provided for retrieval of the harpoon in the event of a miss or for landing a fish if one is speared or harpooned.

Accordingly, it is an object of the present invention to provide a powerful, highly accurate compressed gas powered gun which avoids the hazard of unintentional or accidental discharge.

It is a further object of the invention to provide an efficient and extremely quiet means of firing an arrow or harpoon by providing an arrow which fits over a barrel of a gun and is discharged by an immediate high pressure energization of the gun from a compressed gas source.

It is still a further object of the invention to provide a novel means of holding an arrow over the barrel of a compressed gas powered gun without latching or locking the arrow onto the gun by providing a seating gap which frictionally engages the arrow.

It is yet another object of the invention to allow for the use of arrows with fletching in an arrow gun to seat and hold the arrow in place and to center the barrel to increase the accuracy of the gun upon firing.

A still further object of the invention is to provide an arrow gun with a free floating barrel, such that the barrel is automatically aligned and centered by the arrow as the arrow is loaded onto the barrel of the gun.

BRIEF DESCRIPTION OF THE DRAWINGS

The following objects and other features of the invention will become more readily apparent and may be understood by referring to the following detailed description of an illustrative embodiment of the air powered arrow gun, taken in conjunction with the accompanying drawings, in which.

DETAILED DESCRIPTION OF THE PREFERRED EMBODIMENTS

Figure 1:
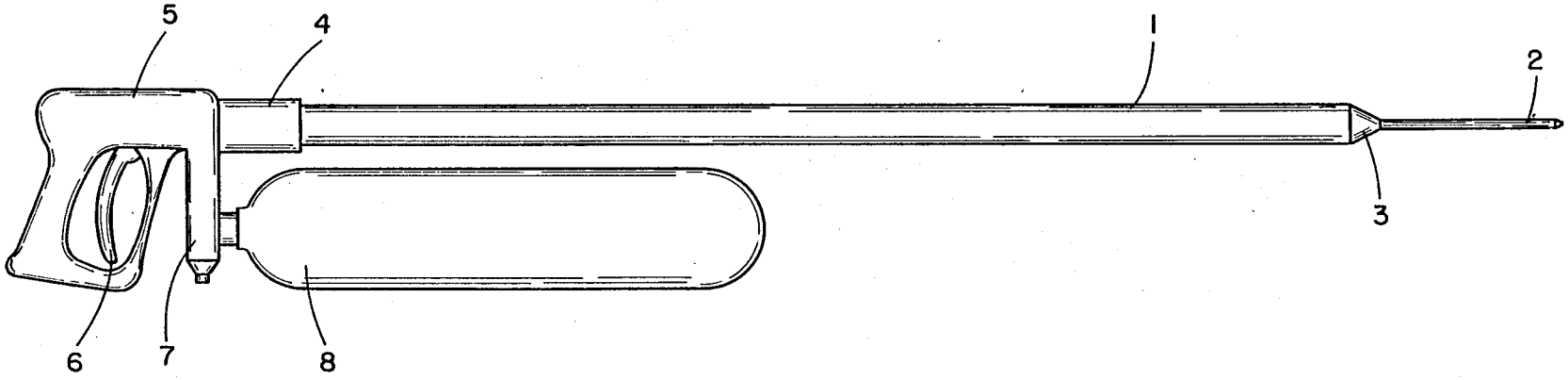
FIG. 1 illustrates a side elevation of a preferred embodiment of the arrow gun pursuant to the present invention.
Figure 2:
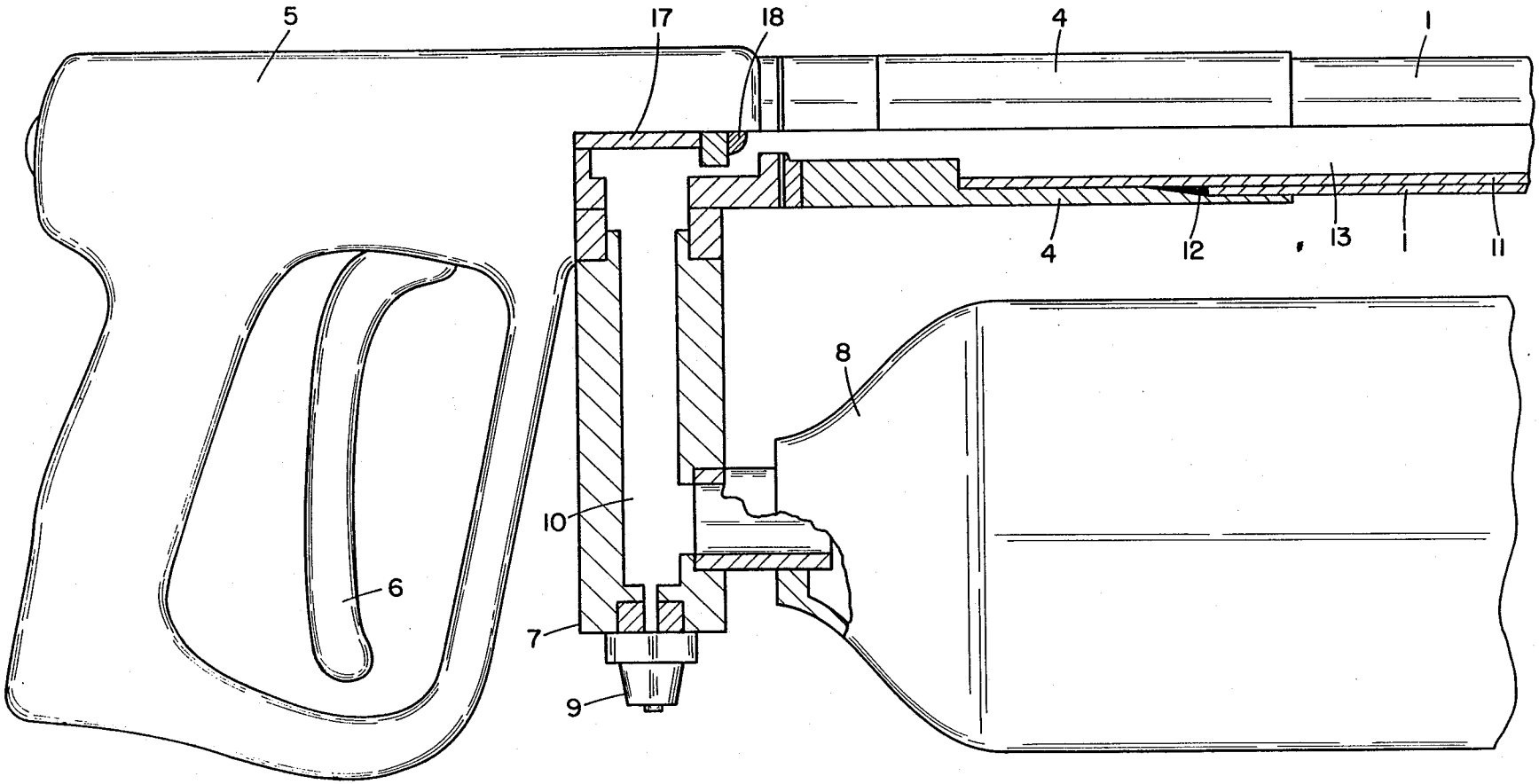
FIG. 2 illustrates an enlarged cut-away side view of the handle and air passageway system of the arrow gun of FIG. 1.

Referring now in specific detail to the drawings, in which identical reference numerals identify similar or identical elements throughout the several views, FIG. 1 shows a preferred embodiment of the arrow gun with an arrow loaded onto the barrel of the gun. The arrow 1 is slid over the barrel 11 as shown in FIG. 2 in frictional engagement, since the outer diameter of barrel 11 is slightly less than the inner diameter of arrow 1. Arrow 1 is hollow, and is provided with a sharpened tip portion 2 which is secured to arrow 1 at an end cap 3. Alternatively, arrow 1 may taper into tip 2 such that tip 2 is part of and integral to arrow 1. Arrow 1 is made of rigid material, and is preferably constructed of lightweight, conventional materials such as aluminum, fiberglass and the like. However, in other embodiments such as described below, heavier, more rigid materials such as steel or stainless steel may be used.

The arrow gun of the present invention comprises essentially a handle 5 which is provided with a system for discharging arrow 1 which includes trigger 6 and compressed gas source 8. The barrel 11 is connected to handle 5 by means of a collar means 4 which secures the barrel 11 and seals it against leakage of pressure by conventional means such as O-rings or gaskets. The compressed gas source 8 as shown may be a compressed air or $CO_2$ container secured by threaded couplings to air passageway chamber 7, and again sealed by conventional means such as O-rings or gaskets and a spring-biased ball valve. Alternatively, the compressed gas source may be a remote tank, mounted for instance on a boat, or a tank such as a scuba tank, or a tank carried by a user of the gun. In such a case, container 8 may be eliminated, and the remote compressed gas source may be connected by means of hoses (not shown) to quick-connect valve 9.

As seen in FIG. 2, chamber 7 is provided with air passageway channel 10 which cooperates with container 8, or alternatively valve 9, and links the compressed gas source with the barrel interior channel 13. Chamber 7 is constructed of a rigid material capable of withstanding the high pressures associated with the compressed gas sources contemplated by the invention, which may be up to 3000 p.s.i. Stop means 17 and seal means 18 are provided which seal off barrel channel 13 such that there is no pressure in channel 13 until actuation of trigger 6. Trigger 6 is preferably biased under tension whereby inadvertent actuation is avoided. The stop means 17 and seal means 18 which isolate the air passageway channel 10 from barrel channel 13 are responsive only to trigger 6 and are biased strongly towards the closed, or sealed position so that only intentional actuation of the trigger causes communication between channels 10 and 13 to deliver gas pressure to the barrel to discharge arrow 1. Upon actuation of the trigger, discharge of the arrow 1 is instantaneous, and there is no prior build-up of pressure to result in a hazardous condition. Upon completion of discharge, the stop means and seal means again isolate barrel channel 13 from air passageway channel 10 to allow for the safe reloading of another arrow 1.

Figure 3A:
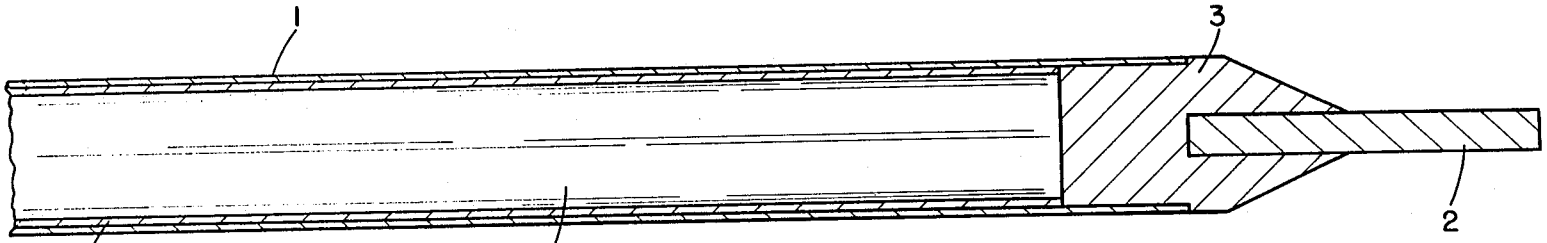
FIGS. 3*a* and 3*b* illustrate an enlarged cut-away side view of the barrel collar assembly of the arrow gun of FIG. 1, with an arrow loaded onto the barrel.
Figure 3B:
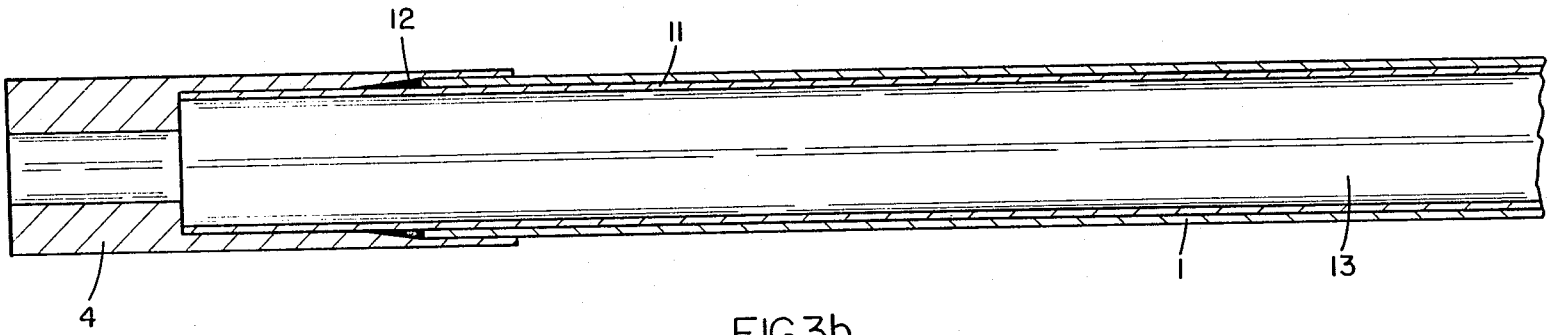

In use, the arrow 1 is slid over and down barrel 11, as seen in FIGS. 2, 3*a* and 3*b*. The tolerances between the diameters of the barrel 11 and the arrow 1 are precise, so that the arrow 1 slidingly engages barrel 11. The arrow 1 slides over the barrel 11 and inside collar 4, which has an inner diameter very close to the outer diameter of the barrel 11 at the handle end of collar 4. Conventional sealing means are provided, such as O-rings, for sealing the connection of barrel 11 to collar 4 to prevent pressure leaks upon firing. The end of collar 4 remote from handle 5 is provided with a tapering inner diameter such that the inner diameter is larger at the remote end than at the handle end. The tapered area forms a seating gap 12 which seats and holds the arrow 1 and restricts its movement so that it does not inadvertently slide off barrel 11. Preferably, barrel 11 terminates at end cap 3 as shown in FIG. 3*a*.

FIGS. 4*a*–4*d* disclose a second embodiment of the present invention, which allows for the use of arrows or harpoons provided with fletching at the end of the arrow opposite the tip 2. Arrow 1*a* is similar to arrow 1 except for the fletching 16 which is conventional and is constructed of a flexible material. Collar 4 is supplemented with a shroud 14 which is connected to collar 4 at mount 15. Alternatively, collar 4 may be eliminated, such that shroud 14 is integral with a collar of its own for connection to handle 5.

Figure 4C:
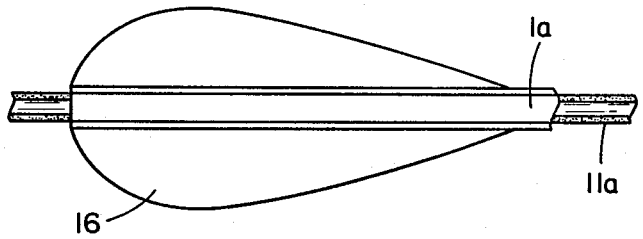
FIG. 4*c* illustrates the arrow of FIG. 4*a* prior to insertion into the shroud cover.
Figure 4D:
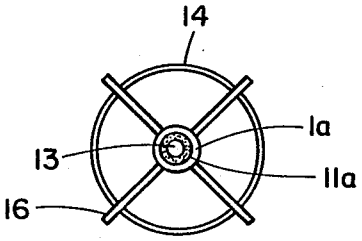
FIG. 4*d* shows the arrow of FIG. 4*c* along lines d—d of FIG. 4*c*.
Figure 4A:
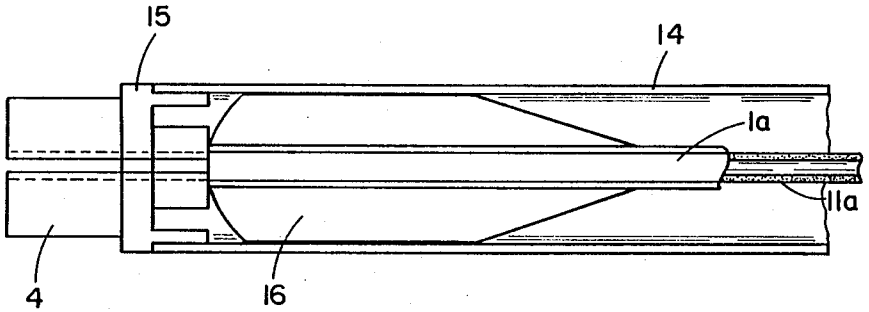
FIG. 4*a* illustrates an enlarged cut-away side view of the shroud cover of a second embodiment of the present invention for use with arrows having fletching.
Figure 4B:
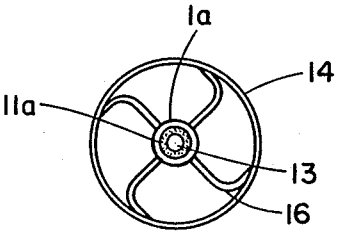
FIG. 4*b* shows the arrow of FIG. 4*a* along lines b—b of FIG. 4*a*.

In use, arrow 1*a* is slid over barrel 11*a* to load the gun as shown in FIG. 4*c*. The diameter formed by fletching 16 is greater than the inner diameter of shroud 14 as shown in FIG. 4*d*. As the fletching 16 reaches the shroud 14, the arrow 1*a* is rotated slightly such that the fletching 16 rolls over to form a helicoil as shown in FIG. 4*b*. The fletching 16 supports and holds the arrow to center the arrow 1*a* for accuracy. Accordingly, the barrel 11*a* may be a "free-floating" barrel, such that its alignment inside shroud 14 need not be purely coaxial before loading, since fletching 16 will perfectly center the arrow 1*a*, and hence the barrel 11*a*, upon loading. Upon firing the-helicoil formed by the fletching 16 causes the arrow 1*a* to spin at a faster rate to create a type of rifling which ensures a more accurate shot.

The arrow gun of the present invention is a highly powerful and accurate gun for firing arrows or harpoons under compressed gas pressure such as compressed air or $CO_2$. Variations on the embodiments described above are contemplated and may include innovations such as tethering a line to the arrow for retrieval purposes, and also mounting the gun on a stand for use on a boat or the like.

While the invention has been particularly shown and described with reference to the preferred embodiments, it will be understood by those skilled in the art that various modifications and changes in form and detail may be made therein without departing from the scope and spirit of the invention. Accordingly, modifications such as those suggested above, but not limited thereto, are to be considered within the scope of the invention.

What is claimed is:

1. An arrow gun for propelling an arrow, harpoon or the like, comprising
   - a handle including a trigger;
   - an elongated barrel extending from said handle;
   - collar means for securing said barrel to said handle, said collar means being fixedly secured at a first end to said handle and circumferentially engaged about said barrel, said collar means having an inner diameter which tapers such that a seating gap is provided at a second end of said collar distant from said handle;
   - a compressed gas source; and
   - connection means including an air passageway for linking said compressed gas source to said barrel;
   - whereby said arrow is hollow and sealed at one end forming a tip and is frictionally disposed over said barrel prior to being propelled, said arrow being secured over said barrel by said tapered seating gap, said arrow being under pressure only upon actuation of said trigger.

2. An arrow gun according to claim 1, wherein said barrel is hollow and said compressed gas is released under pressure from said barrel at an end remote from said handle to propel said arrow.

3. An arrow gun according to claim 2, wherein said barrel is sealingly and detachably secured to said collar means so as to prevent pressure release, thereby maintaining release of pressure only at said end remote from said handle.

4. An arrow gun according to claim 1, wherein said seating gap in said collar means frictionally engages an end of said arrow remote from said tip at an open end of said arrow to restrict its movement prior to firing.

5. An arrow gun according to claim 4, wherein said seating gap centers said arrow over said barrel to prepare said arrow for firing.

6. An arrow gun according to claim 1, wherein said collar means has an inner diameter at said first end which is slightly larger than said barrel outer diameter, said inner diameter of said collar means tapering outwardly at said second end to be slightly larger than said arrow outer diameter, thereby defining said seating gap for frictionally engaging said arrow.

7. An arrow gun according to claim 6, wherein said arrow has an inner diameter slightly larger than said barrel outer diameter, said arrow further having an outer diameter slightly less than said collar means inner diameter at said seating gap.

8. An arrow gun according to claim 1, wherein said compressed gas source is detachable and comprises a high pressure compressed air source.

9. An arrow gun according to claim 1, wherein said compressed gas source comprises a $CO_2$ source.

10. An arrow gun according to claim 1, wherein said compressed gas source is remote from said gun and is connected to said gun by high pressure hoses.

11. An arrow gun according to claim 1, wherein said compressed gas source energizes said gun only upon actuation of said trigger.

12. An arrow gun according to claim 1, wherein said connection means are responsive to said trigger such that said air passageway is pressurized only upon actuation of said trigger.

13. An arrow gun according to claim 1, wherein said arrow is of a longer length than said barrel.

14. An arrow gun for propelling a hollow arrow, said arrow including fletching at one end, comprising a handle including a trigger;

a barrel extending from said handle;

a compressed gas source responsive to said trigger to provide energy to said barrel; and shroud means attached to said handle and surrounding a length of said barrel, said shroud having an inner diameter slightly less than an outer diameter defined by said fletching of said arrow, such that said fletching is rolled upon contact with said shroud.

whereby said arrow is disposed over said barrel and said fletching is frictionally engaged within said shroud means to hold said arrow in place and coaxially center and align said arrow and barrel with said shroud, such that said fletching uncoils to increase speed of rotation and accuracy of said arrow as said arrow is propelled by said compressed gas energy upon actuation of said trigger.

15. An arrow gun according to claim 14, wherein said arrow has an inner diameter slightly larger than said barrel outer diameter.

16. An arrow gun according to claim 14, wherein said compressed gas source comprises a high pressure compressed air source.

17. An arrow gun according to claim 14, wherein said compressed gas source comprises a $CO_2$ source.

18. A method of propelling an arrow from a gun, comprising sliding said arrow over an elongated discharge barrel of said gun, said gun including a handle and trigger assembly and said barrel being connected to said handle at one end of said barrel;

engaging by means of friction an end of said arrow at said handle end of said barrel to restrict its movement by sliding said arrow into a tapered seating gap provided in a collar securing said barrel to said handle assembly; and activating a compressed gas source to energize said barrel of said gun;

whereby said arrow is instantaneously propelled from said gun upon activation of said gas source by sliding off said barrel under high pressure.

19. A method according to claim 18, wherein said activating step comprises actuating said trigger, thereby supplying said barrel with compressed gas to propel said arrow.

20. A method of propelling an arrow from a gun, comprising sliding said arrow over an elongated discharge barrel of said gun, said gun including a handle and trigger assembly and said barrel being connected to said handle at one end of said barrel;

engaging by means of friction an end of said arrow at said handle end of said barrel to restrict its movement by sliding an arrow provided with fletching over said barrel into a shroud coaxially arranged over said barrel and secured to said handle, such that said fletching contacts an inner surface of said shroud to restrict sliding movement of said arrow; and activating a compressed gas source to energize said barrel of said gun;

whereby said arrow is instantaneously propelled from said gun upon activation of said gas source by sliding off said barrel under high pressure.

21. A method according to claim 20, wherein said activating step comprises actuating said trigger, thereby supplying said barrel with compressed gas to propel said arrow.

* * * * *